US009837769B2

(12) United States Patent
Yu et al.

(10) Patent No.: US 9,837,769 B2
(45) Date of Patent: Dec. 5, 2017

(54) USB CONNECTOR HAVING AN IMPROVED GROUNDING

(71) Applicant: ALLTOP ELECTRONICS (SUZHOU) LTD., Taicang, JiangSu Province (CN)

(72) Inventors: Wang-I Yu, New Taipei (TW); Ya-Juan Gou, Taicang (CN); Zhi-Qiang Rong, Taicang (CN); Mao-Jung Huang, New Taipei (TW); Yun Zhu, Taicang (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 15/344,656

(22) Filed: Nov. 7, 2016

(65) Prior Publication Data

US 2017/0310054 A1 Oct. 26, 2017

(30) Foreign Application Priority Data

Apr. 26, 2016 (CN) ..... 2016 1 0263456

(51) Int. Cl.

| | |
|---|---|
| ***H01R 13/658*** | (2011.01) |
| ***H01R 13/652*** | (2006.01) |
| ***H01R 24/60*** | (2011.01) |
| ***H01R 12/71*** | (2011.01) |
| *H01R 107/00* | (2006.01) |

(52) U.S. Cl.

CPC ..... *H01R 13/652* (2013.01); *H01R 12/716* (2013.01); *H01R 24/60* (2013.01); *H01R 2107/00* (2013.01)

(58) Field of Classification Search

CPC ..... H01R 23/02; H01R 24/60; H01R 13/648; H01R 13/6581; H01R 13/6585; H01R 13/658; H01R 23/688

USPC ..... 439/607.01, 607.05, 607.08, 660

See application file for complete search history.

(56) References Cited

U.S. PATENT DOCUMENTS

| | | | | |
|---|---|---|---|---|
| 7,534,141 | B1 * | 5/2009 | Wu | H01R 24/62 439/607.01 |
| 8,920,197 | B2 * | 12/2014 | Tziviskos | H01R 13/405 439/660 |
| 9,337,585 | B1 * | 5/2016 | Yang | H01R 13/6583 |
| 9,590,364 | B1 * | 3/2017 | Chang | H01R 13/6581 |

(Continued)

*Primary Examiner* — Abdullah Riyami
*Assistant Examiner* — Thang Nguyen
(74) *Attorney, Agent, or Firm* — Sughrue Mion, PLLC

(57) ABSTRACT

A Universal Serial Bus connector includes a first contact module, a second contact module, a shielding shell enclosing the contact modules, and a grounding member. The contact modules each have a number of contacts and an insulator retaining the contacts. Each contact has a fastening portion assembled in the insulator, a contacting portion extending from the fastening portion, and a tail portion extending from the fastening portion opposite to the contacting portion. The contacts include grounding contacts. The shielding shell provides a front mating face. The grounding member connects with the grounding contacts and extends in different plane compared to the grounding contacts. The grounding member defines a front contact tab and the grounding contact defines a front edge end. The front contact tab is closer to the front mating face of the shielding shell than the front edge ends of the grounding contacts.

14 Claims, 10 Drawing Sheets

(56) References Cited

U.S. PATENT DOCUMENTS

| | | | | |
|---|---|---|---|---|
| 2012/0052739 | A1* | 3/2012 | Wang | H01R 12/724 439/660 |
| 2014/0370729 | A1* | 12/2014 | Wang | H01R 13/6471 439/108 |
| 2016/0013599 | A1* | 1/2016 | Ueda | H01R 13/6596 439/607.01 |
| 2016/0380389 | A1* | 12/2016 | Ju | H01R 13/6585 439/607.05 |

* cited by examiner

USB CONNECTOR HAVING AN IMPROVED GROUNDING

BACKGROUND

1. Technical Field

The present disclosure relates to an electrical connector, and more particularly to a Universal Serial Bus (USB) connector with grounding means for mounting onto a printed circuit board.

2. Description of Related Art

The USB-IF announced USB Type-C™ standards in 2014. This kind of connector of USB Type-C™ features double-direction insertions. In the same time, the transmission rate and shielding performance are improved. This type of connector requires a high signal transmission quality which needs to employ grounding means for grounding purpose.

Hence, there is a need to provide a Universal Serial Bus connector with improved grounding means.

SUMMARY

The present disclosure includes a Universal Serial Bus connector pluggable with a complementary connector. The Universal Serial Bus connector comprises a first contact module, a second contact module, a shielding shell enclosing the first and the second contact modules, and a grounding member. The first contact module comprises a plurality of first contacts and a first insulator retaining the first contacts. Each of the plurality of first contacts comprises a first fastening portion assembled in the first insulator, a first contacting portion extending from the first fastening portion, and a first tail portion extending from the first fastening portion opposite to the first contacting portion. The first contacts comprise a pair of grounding contacts. The second contact module comprises a plurality of second contacts and a second insulator retaining the second contacts. Each of the plurality of second contacts comprises a second fastening portion assembled in the second insulator, a second contacting portion extending from the second fastening portion, and a second tail portion extending from the second fastening portion opposite to the second contacting portion. The second contacts comprise a pair of grounding contacts. The shielding shell provides a front mating face. The grounding member connects with the grounding contacts and extends in different plane compared to the grounding contacts. The grounding member defines a front contact tab for contacting with the complementary connector and the grounding contact defines a front edge end. The front contact tab is closer to the front mating face of the shielding shell than the front edge ends of the grounding contacts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
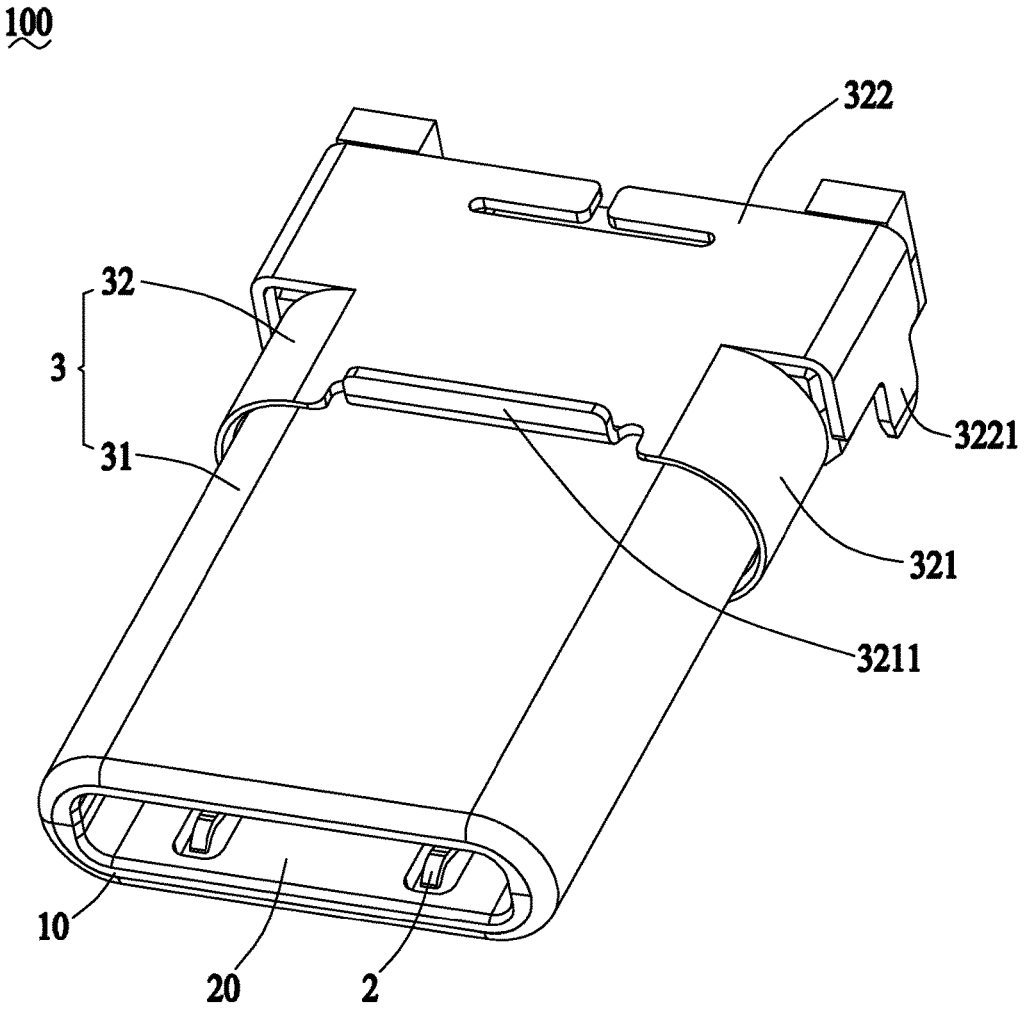
FIG. 1 is a perspective view of a USB 2.0 type C connector in accordance with the present invention.

Reference will now be made to the drawing figures to describe the embodiments of the present disclosure in detail. In the following description, the same drawing reference numerals are used for the same elements in different drawings.

Referring to FIGS. 1 to 6, an illustrated embodiment of the present invention discloses an electrical connector 100 which complies to standard USB 2.0 Type-C™. The electrical connector or the USB connector 100 is employed to mounted onto a printed circuit board (not shown) and engages with a complementary connector (not shown). The electrical connector 100 includes contact modules 1, a shielding shell 3 enclosing the contact modules 1 and a grounding member 2 electrically connecting with the shielding shell 3.

The contact modules 1 include a first contact module 4, a second contact module 5 and a spacer 6 for fixing the first and the second contact modules 4, 5 together. The first contact module 4 and the second contact module 5 are assembled along an upper-to-down direction, i.e. a thickness direction of the electrical connector 100. It should be noted here that the spacer 6 can be removed by other means which can also connect together the first and the second contact modules 4, 5. For example, such other means could be a block and a recess engageable with the block.

Figure 3:
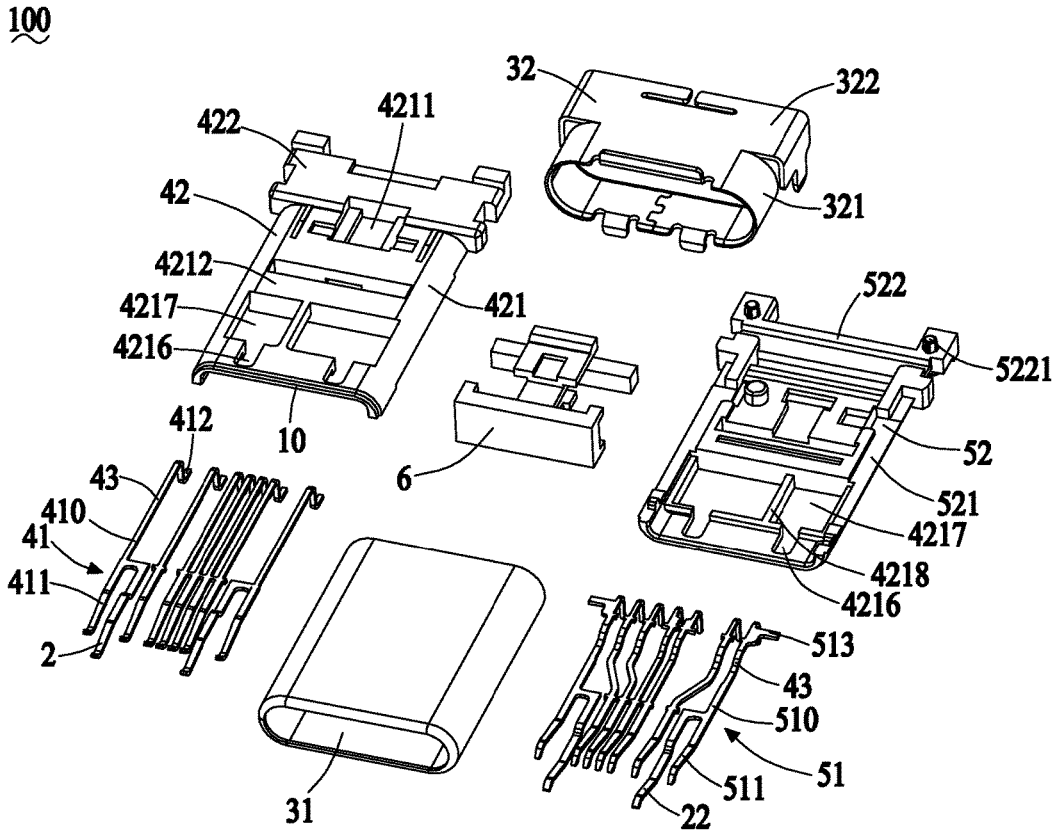
FIG. 3 is an exploded view of the USB connector as shown in FIG. 1.
Figure 4:
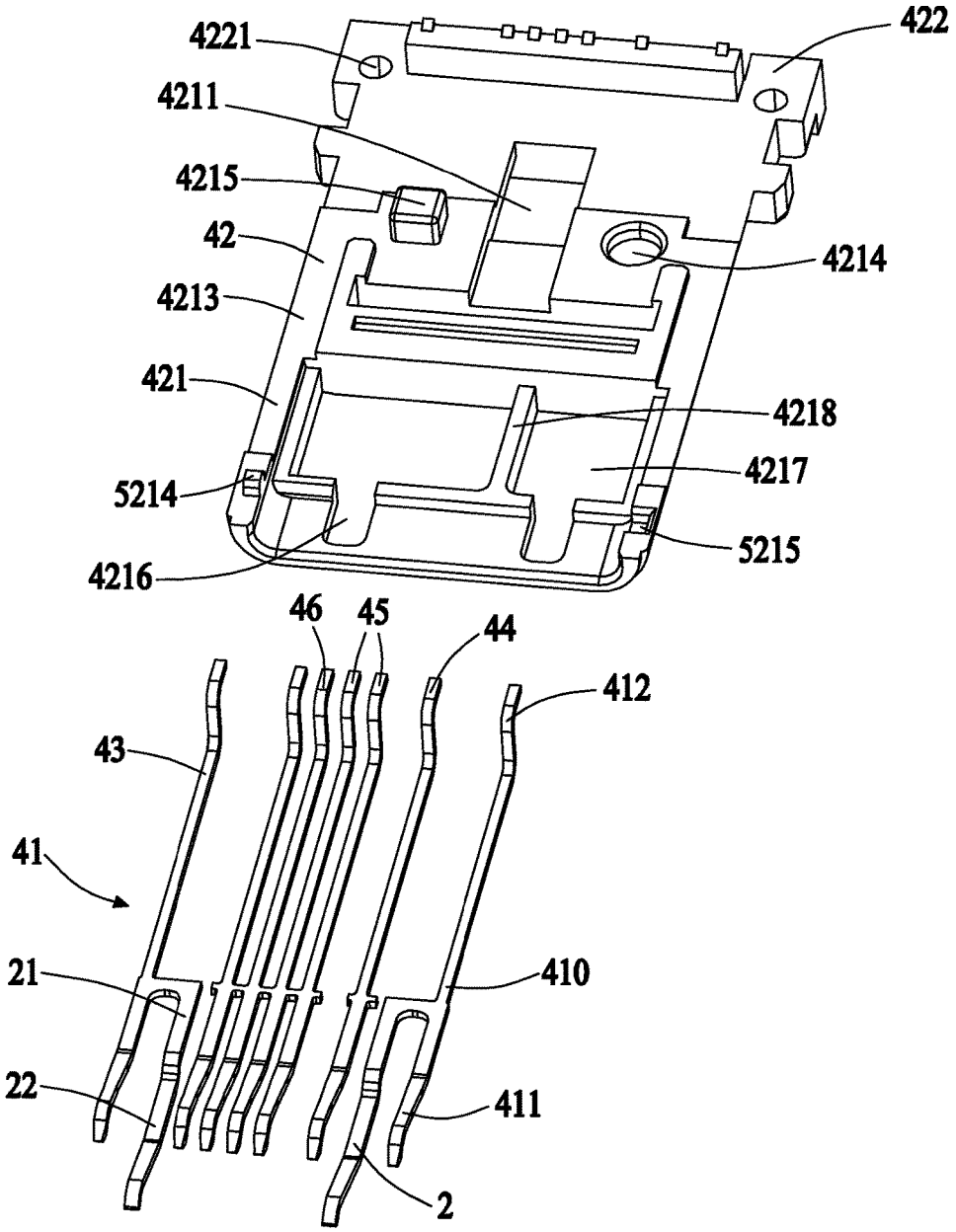
FIG. 4 is an exploded, perspective view of a first contact module as shown in FIG. 2.
Figure 5:
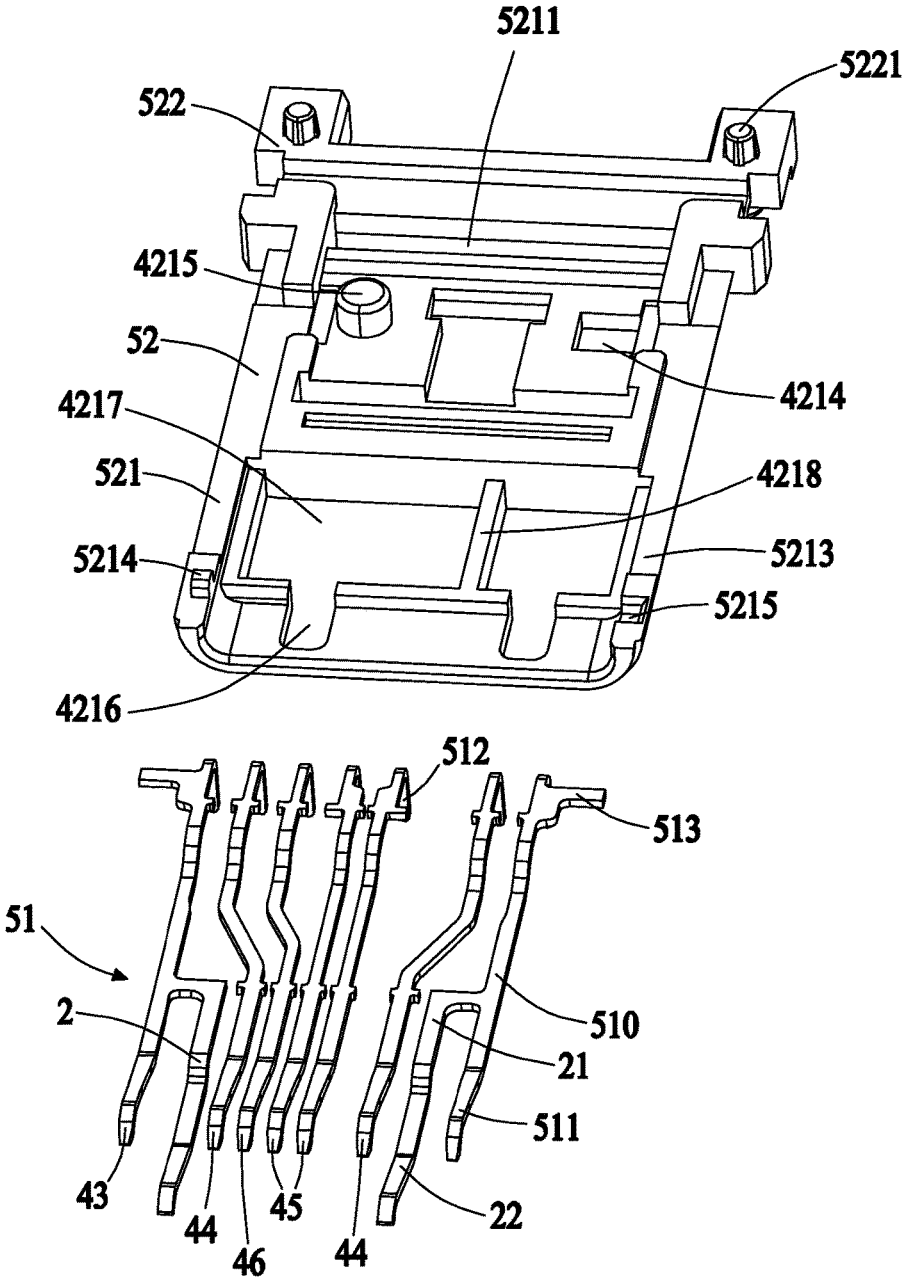
FIG. 5 is an exploded, perspective view of a second contact module as shown in FIG. 2.

Turning to FIGS. 4 and 5 with FIG. 3, the first contact module 4 has a plurality of first contacts 41 and a first insulator 42 securing the plurality of first contacts 41. The first contacts 41 each have a first fastening portion 410 assembled in the first insulator 42, a first contacting portion 411 extending from one end of the first fastening portion 410 and a first tail portion 412 extending from an opposite end of the first fastening portion 410 for soldering on the printed circuit board. In this preferred embodiment, the first contacts 41 are arranged in one row and insert-molded within the first insulator 42. The first tail portion 412 extends downwards from the first fastening portion 410 and towards the printed circuit board along a horizontal direction to thereby soldered thereto. The first tail portions 412 are transversally positioned in one row.

The second contact module 5 has a plurality of second contacts 5 and a second insulator 52 securing the second plurality of second contacts 5. The second contacts 51 each have a second fastening portion 510 assembled in the second insulator 52, a second contacting portion 511 extending from one end of the second fastening portion 510 and a second tail portion 512 extending from an opposite end of the second fastening portion 510. In this preferred embodiment, the second contacts 51 are arranged in one row and insert-molded within the second insulator 52. The second tail portion 512 perpendicularly extends downwards from the second fastening portion 510 and towards the printed circuit board. The second tail portions 512 are arranged in one row.

The first contacts 41 and the second contacts 51 each comprise two grounding contacts 43, two power contacts 44 next to the two grounding contacts 43, and a differential pair 45 and a detecting contact 46 positioned between the two power contacts 44. Such an arrangement of the first contacts 41 and the second contacts 51 are meeting with the standard connector of USB 2.0 Type-C™.

The first insulator 42 comprises a first tongue section 421 and a first assembling section 422 connecting with the first tongue section 421. The dimensions of the first tongue section 421 is smaller than the dimensions of the first assembling section 422 either from an upper-to-down direction or a left-to-right direction. A first recess 4211 is defined between an intersection of the first tongue section 421 and the first assembling section 422. The first recess 4211 extends throughout the first insulator 42 for providing space to the die (not shown). The first tongue section 421 forms an outer surface 4212 confronting the shielding shell 3 and an inner surface 4213 confronting the second insulator 52. A positioning hole 4214 is recessed from the inner surface 4213 and a positioning post 4215 is formed oppositely. A pair of engaging grooves 4221 are recessed from an inside wall of the first assembling section 422 and face towards the second insulator 52.

The second insulator 52 includes a second tongue section 521 and a second assembling section 522 connecting with the second tongue section 521. The dimensions of the second tongue section 521 is smaller than the dimensions of the second assembling section 522 either from an upper-to-down direction or a left-to-right direction. An engaging space 20 is defined by forward ends of the first and the second tongue sections 421, 521 to thereby receiving the contacting portions 411, 511. A pair of engaging cutouts 5215 are respectively formed in the forward ends of the first tongue section 421 and the second tongue section 521. Correspondingly, a pair of engaging blocks 5214 which can be blocked in corresponding engaging cutouts 5215, are formed respectively in the forward ends of the first tongue section 421 and the second tongue section 521. A pair of engaging posts 5221 are formed on the second assembling section 522 for engaging with the pair of engaging grooves 4221 of the first assembling section 422.

Similarly, the second tongue section 521 defines an outer face confronting the shielding shell 3 and an inner face 5213 confronting the first insulator 42. A second recess 5211 is also recessed from the inner face 5213. The first contact module 4 and the second contact module 5 are fixedly assembled together by the engagements between the positioning posts 4215 with the positioning holes 4214, the engaging cutouts 5215 with the engaging blocks 5214, and the engaging posts 5221 with the engaging grooves 4221. It can be understood that the shapes and the configurations of the above-described engageable members are changeable according to different requirements. The grounding contact 43 of the second contact 51 provides a horizontal extending, beam 513 at a distal rear end thereof. The beam 513 is insert-molded within the second assembling section 522 of the second insulator 52.

Referring to FIGS. 4 and 5, the electrical connector 100 also comprises a resilient pad 2 which is connecting to the grounding contact 43 of the first contacts 41 and the second contacts 51. The resilient pad 2 and the grounding contact 43 to which the resilient pad 2 connects, extend in different planes. The grounding contacts 43 of the first contacts 41 and the second contacts 51 each is formed with such a resilient pad 2. From a side view, a front contact tab 22 of the resilient pad 2 is located between a front edge end of the first and the second contacting portion 411, 511 and a front mating face 10 of the electrical connector 100. In this preferred embodiment, the resilient pad 2 extends from a side edge of the first fastening portion 410 or the second fastening portion 510, and locates between the grounding contact 43 and the power contact 44. The resilient pad 2 is performed as a grounding member and is formed in an L-shape. The L-shape resilient pad 2 has an L-shape connecting bar 21 interconnecting to the first fastening portion 410 or the second fastening portion 510, and the front contact tab 22 projecting from the L-shape connecting end 21 and extending towards the front mating face 10. The connecting bar 21 is insert-molded within corresponding first insulator 42 or the second insulator 52. The front contact tab 22 protrudes either upwards or downwards compared to the grounding contact 43 so that the front contact tab 22 and the connecting bar 21 extend within different planes. The front contact tab 22 of this preferred embodiment projects towards the front mating face 10 beyond the front edge end of the first contacting portion 411 or the second contacting portion 511. In other words, the front contact tab 22 is closer to the front mating face 10 of the shielding shell 3 than the front edge end.

The first tongue section 421 of the first insulator 42 and the second tongue section 521 of the second insulator 52 each define a receiving opening 4217 and a plurality of receiving grooves 4216 communicating with the receiving opening 4217. The first and the second contacting portions 411, 511 are exposed within the receiving opening 4217 and the front contact tabs 22 of the L-shaped resilient pads 2 are exposed within corresponding receiving grooves 4216. A separating beam 4218 is provided on the first contact module 41 and the second contact module 51, which extends along a front-to-back direction and divides the receiving opening 4217 into two parts. The separating beam 4218 increases the rigidity of the first and the second tongue sections 421, 521.

Figure 2:
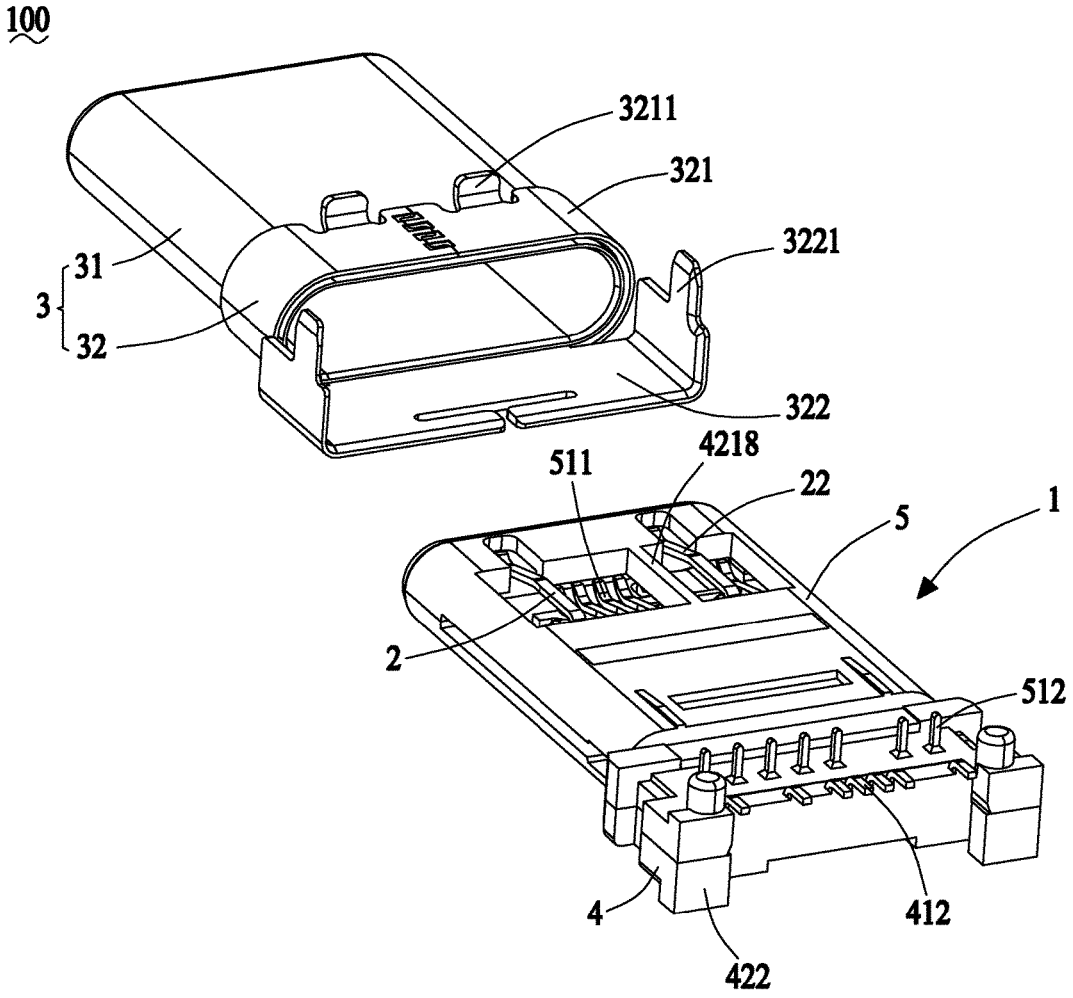
FIG. 2 is partially exploded, perspective view of the USB connector as shown in FIG. 1.
Figure 6:
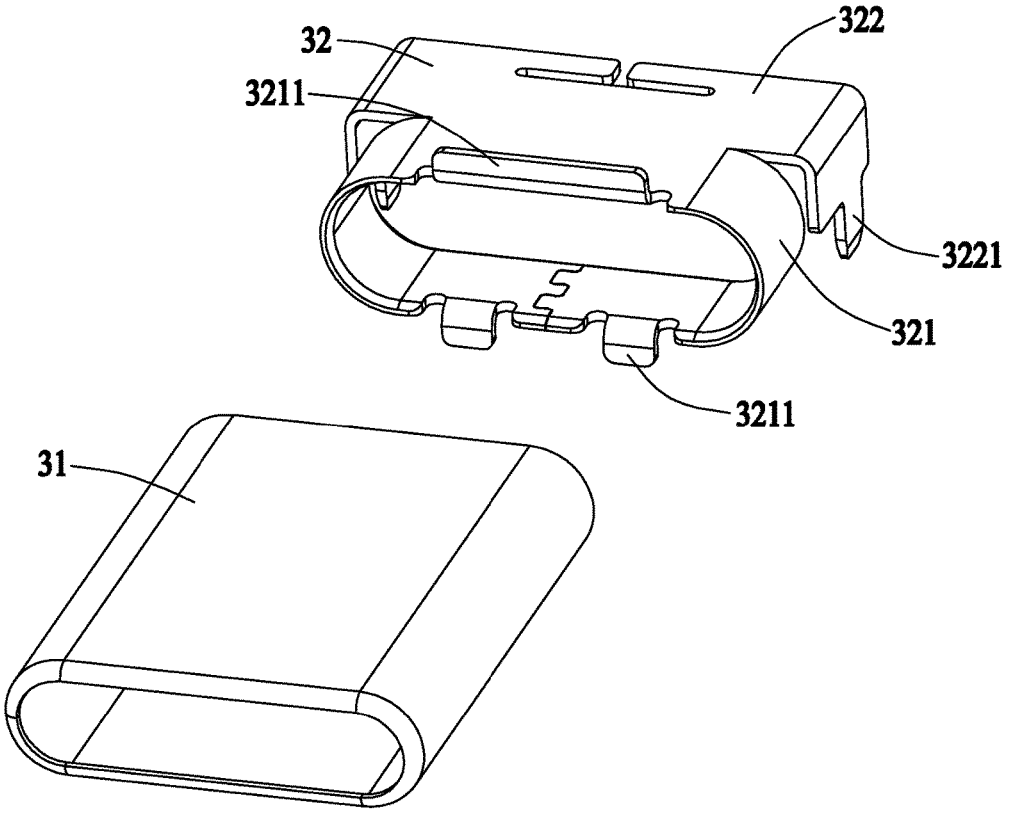
FIG. 6 is an exploded, perspective view of a shielding shell as shown in FIG. 2.

Referring to FIGS. 1, 2 together with FIG. 6, the shielding shell 3, enclosing the first contact module 4 and the second contact module 5, comprises an inner shell 31 partially covering the first and the second contact modules 4, 5 and an outer shell 32 partially overlapped with and covering the inner shell 31. In details, the inner shell 31 encloses entirely the first and the second tongue sections 421, 521, and the outer shell 32 encloses the first and the second assembling sections 422, 522. The inner shell 31 is integrally formed from one piece of metal material and has an elliptical cross-section. The outer shell 32 includes a first shielding section 321 assembled to a rear side of the inner shell 31 and a second shielding section 322 enclosing the first assembling section 422 and the second assembling section 522. The first shielding section 321 forms a plurality of front erecting edges 3211 at opposite upper and lower sides thereof to reinforce the whole strength during insert-molding. A plurality of solder tails 3221 are provided at respective opposite sides of the second shielding section 322 to soldering the outer shell 32 to the printed circuit board. The shape of the first shielding section 321 of the outer shell 32 is substantially identical to the shape of the inner shell 31 to thereby facilitate soldering between these two shells 31, 32.

Figure 7:
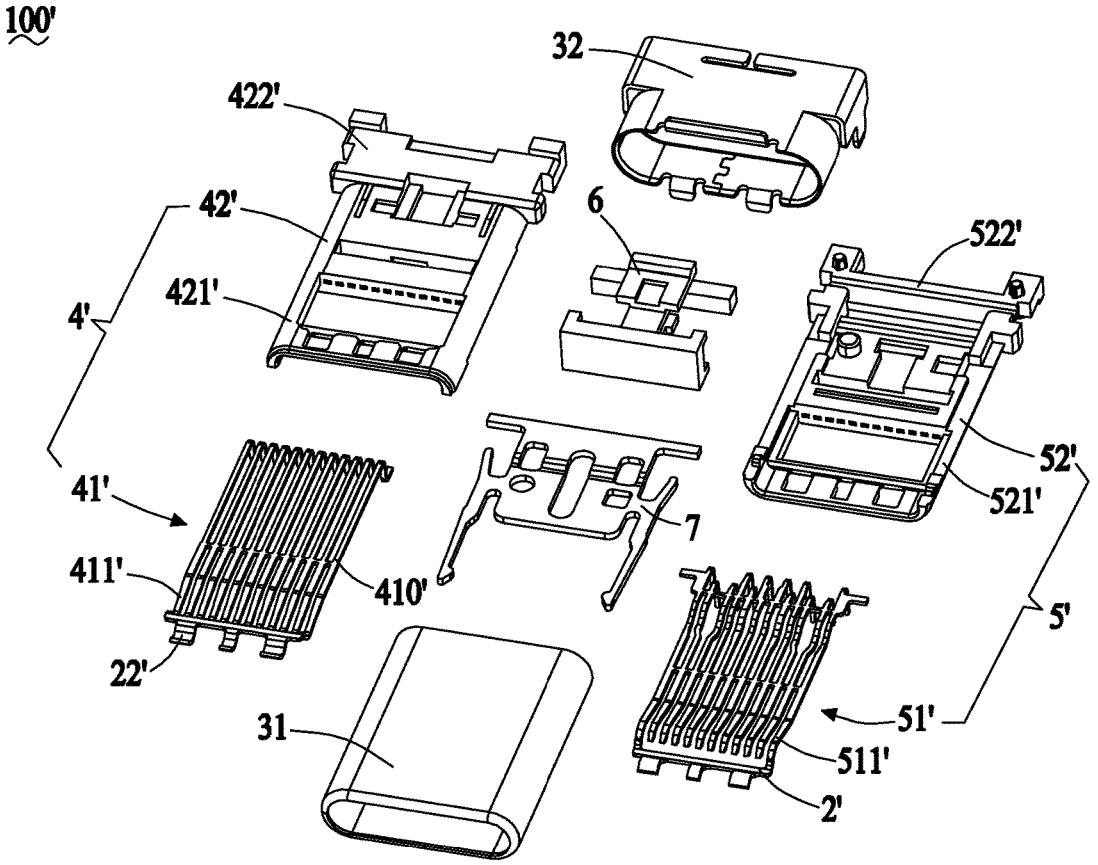
FIG. 7 is an exploded, perspective view of a USB 3.1 type C connector, in accordance with the other embodiment of the present invention.
Figure 8:
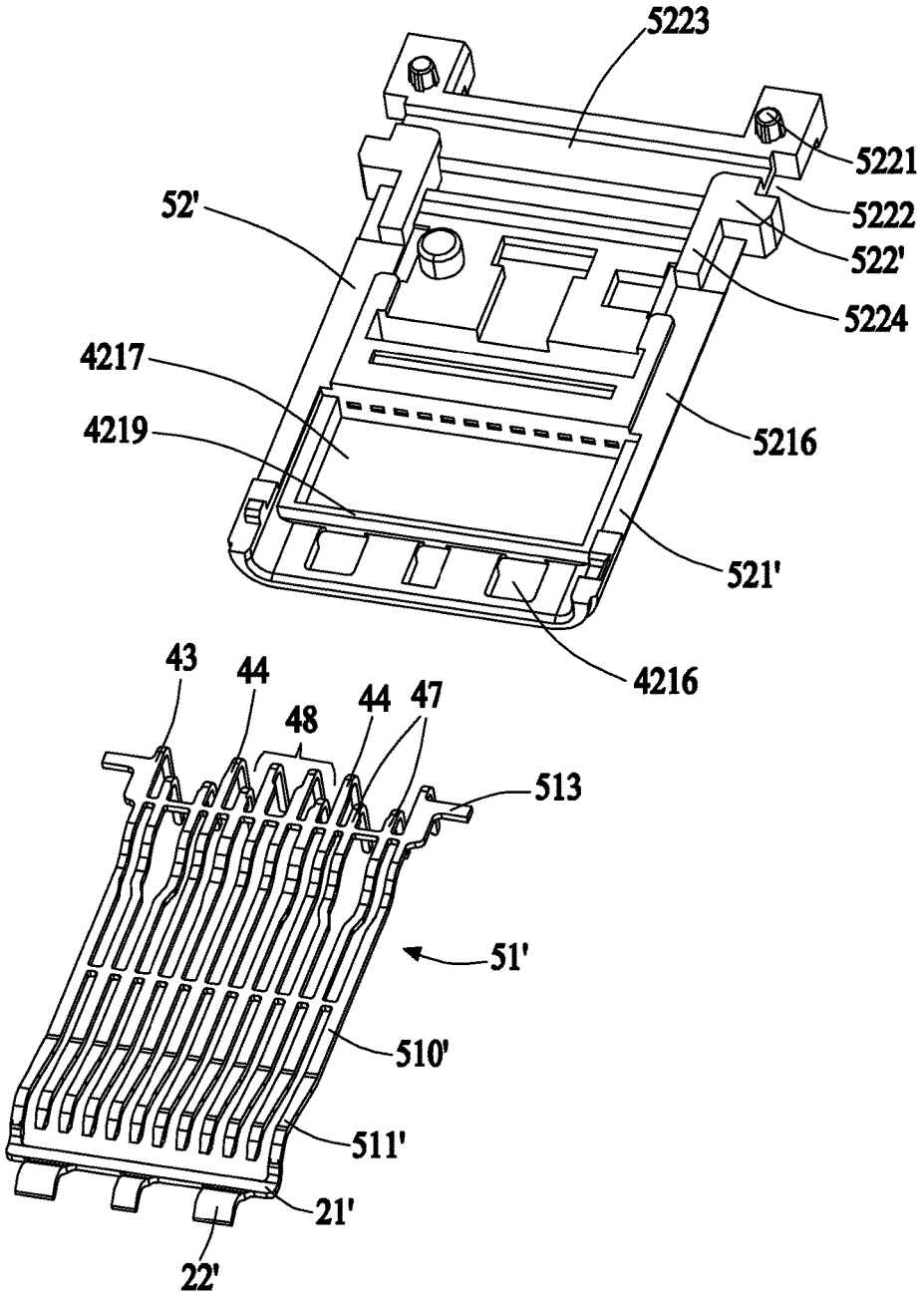
FIG. 8 is an exploded, perspective view of the second contact module shown in FIG. 7.
Figure 9:
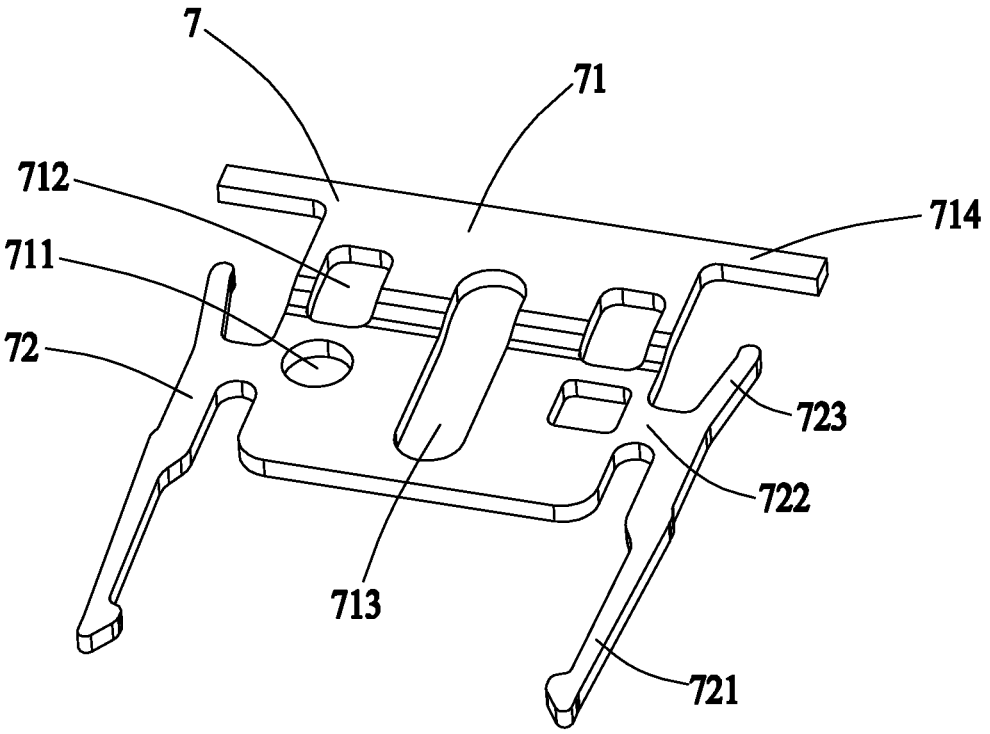
FIG. 9 is a perspective view of a central grounding pad shown in FIG. 7.

Referring to FIGS. 7 to 9, the other embodiment of the present invention, of which the electrical connector complies with the standard USB 3.1 Type-C™, is shown. The structures of the two embodiments are similar. The main differences are in the arrangement of the contacts and the electrical connector 100' further includes a central grounding pad or central grounding unit 7. Another difference is the structure of the grounding member 2. Hereinafter, the details of the differences will be introduced one by one.

In this embodiment, both the first and the second contacts 41', 51' have a pair of grounding contacts 43, two differential pairs 47 next to the grounding terminals 43, two power contacts 44 neighbored to the differential pairs 47, and four signal contacts 48 between the two power contacts 44. Such an arrangement of the contacts 41', 51' comply with the standard USB 3.1 Type-C™. Compared to the electrical connector 100 with the first embodiment, the electrical connector 100' provides the central grounding pad 7 fixed between the first contact module 4 and the second contact module 5. The central grounding pad 7 is configured to have a main section 71 sandwiched between the first and the second fastening portions 410', 510', and a pair of latches 72 projecting from opposite sides of the main section 71 and located adjacent to the first contacting portions 411' and the second contacting portions 511' for prohibiting cross-talk. The main section 71 of the central grounding pad 7 defines a pair of positioning holes 711 to cooperate with the positioning posts 4215, a pair of rectangular slits 712 and an elongated slit 713 positioned between the two positioning holes 711. The first recess 4211, the second recess 5211 and the elongated slit 713 are communicating with each other in order to secure together the first contact module 4', the second contact module 5' and the central grounding pad 7 by insert-molding the spacer 6 therein. The central grounding pad 7 defines a pair of horizontal, oppositely extended sections 714 from a back end thereof. The horizontal, oppositely extended sections 714 each have a distal end protrude beyond the second assembling section 522' from a slot 5222 thereof to thereby electrically connect to the shielding shell 3. The second assembling section 522' defines a restriction recess 5223 recessed therefrom for receiving the horizontal, extended sections 714. The restriction recess 5223 and the slot 5222 are communicate with each other. A separating block 5224 is formed at the intersection of the second tongue section 521' and the second assembling section 522' in order to isolate a rear end of the latches 72 with the main section 71. The latches 72 each include a locking arm 721, a resilient arm 723 adjacent to the first or the second fastening portion 410', 510', and a connecting arm 722 connecting the main section 71 with the locking arm 721.

Correspondingly, both the first tongue section 421' or the second tongue section 521' provide a receiving cutout 5216 at opposite sides thereof. The latches 72 are disposed within the corresponding receiving cutout 5216 with a front distal end thereof protruding into the engaging space 20 through the receiving cutout 5216 for contacting with the complementary connector. The resilient arm 723 has a rear distal end thereof protruding beyond the first insulator 42' and the second insulator 52' through the receiving cutout 5216 for contacting with the inner side face of the inner shell 31.

Figure 10:
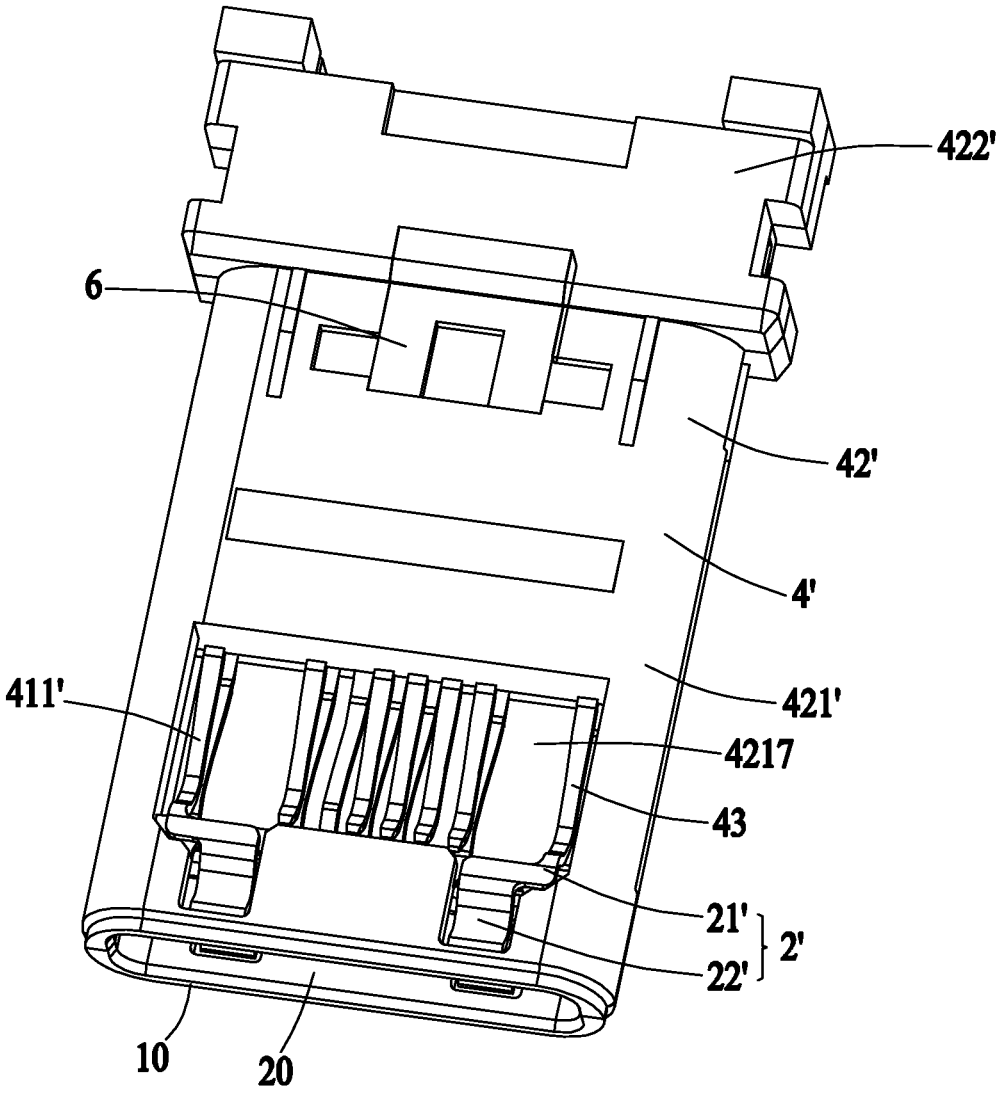
FIG. 10 is a perspective view of a grounding member applied in a contact module of a USB 2.0 type C connector.

Compared to the above-described electrical connector 100 of the first embodiment, the grounding member 2' of the electrical connector 100' of the second embodiment, extends from front distal ends of the first contacting portion 411' or the second contacting portion 511' of the grounding contact 43. The grounding member 2' of this embodiment comprises a connecting bar 21' interconnecting the two distal ends of the first or the second contacting portions 411', 511', and a plurality of front contact tabs 22' extending forwardly from a transversal, forward edge of the connecting bar 21'. It should be noted here that the resilient pads can be deemed as a connecting part for connecting the connecting bar 21' with the distal ends of the first or the second contacting portions 411', 511'. The resilient pads and the connecting bar 21' form a substantial U-shaped configuration. The connecting bar 21' could be also formed by two separating parts which may be used in USB 2.0 type C connector, as shown in FIG. 10.

In order to co-work with the grounding member 2', the first tongue section 421' of the first insulator 42' and the second tongue section 521' of the second insulator 52' each define a receiving opening 4217 and a plurality of receiving grooves 4216 communicating with the receiving opening 4217. While, a separating beam 4219 is provided to isolate the receiving opening 4217 with the plurality of the receiving grooves 4216.

In conclusion, the grounding member 2, 2' employed in the USB connector 100, 100', not only establishes an electrical connection between the grounding contact to the shielding shell and the printed circuit board in a simply way, but also contacts to the complementary connector in a resilience way.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A Universal Serial Bus connector pluggable with a complementary connector, comprising:

a first contact module comprising a plurality of first contacts and a first insulator retaining said first contacts, each of said plurality of first contacts comprising a first fastening portion assembled in said first insulator, a first contacting portion extending from said first fastening portion, and a first tail portion extending from said first fastening portion opposite to said first contacting portion, said first contacts comprising a pair of grounding contacts;

a second contact module comprising a plurality of second contacts and a second insulator retaining said second contacts, each of said plurality of second contacts comprising a second fastening portion assembled in said second insulator, a second contacting portion extending from said second fastening portion, and a second tail portion extending from said second fastening portion opposite to said second contacting portion, said second contacts comprising a pair of grounding contacts;

a shielding shell enclosing said first and said second contact modules, said shielding shell providing a front mating face; and a plurality of grounding members each connecting with respective ones of said grounding contacts of said first and said second contacts, said grounding members and said grounding contacts extending within different planes;

wherein said grounding member defines a front contact tab for contacting with said complementary connector and said grounding contact defines a front edge end, and said front contact tab is closer to said front mating face of said shielding shell than said front edge end.

2. The Universal Serial Bus connector as claimed in claim 1, wherein each grounding member is formed with one resilient pad extending from a corresponding grounding contacts of said first contacts and said second contacts.

3. The Universal Serial Bus connector as claimed in claim 2, wherein each resilient pad is configured in an L-shape, and wherein said front contact tab of said L-shaped resilient pad of said first contact projects oppositely to said front contact tab of said L-shaped resilient pad of said second contact.

4. The Universal Serial Bus connector as claimed in claim 3, wherein said first insulator and said second insulator each defines a receiving opening and a plurality of receiving grooves communicating with said receiving opening, and wherein said first and said second contacting portions are exposed within said receiving opening and said front contact tabs of said L-shaped resilient pads are exposed within corresponding receiving grooves.

5. The Universal Serial Bus connector as claimed in claim 4, wherein a separating beam is provided on said first contact module and said second contact module, and wherein said separating beam extends along a front-to-back direction and divides said receiving opening into two parts.

6. The Universal Serial Bus connector as claimed in claim 2, wherein said grounding members form a pair of connecting bar each interconnecting said resilient pads of said first contacts and said resilient pads of said second contacts, and wherein said grounding members comprise a plurality of front contact tabs extending forwards from said connecting bar along a lengthwise direction of said connector.

7. The Universal Serial Bus connector as claimed in claim 6, wherein said front contact tabs of said first contacts are bent in opposite direction to said front contact tabs of said second contacts, and wherein said connecting bars extend transversely and positioned in front of said first and said second contacts.

8. The Universal Serial Bus connector as claimed in claim 6, wherein said first insulator and said second insulator each defines a receiving opening for exposing therefrom said first and said second contacting portions and a plurality of receiving grooves for exposing therefrom said front contact tabs of said grounding member, respectively, and wherein separating beams are provided correspondingly on said first insulator and said second insulator which are employed for isolating said receiving opening and said receiving grooves.

9. The Universal Serial Bus connector as claimed in claim 3, further comprising a central grounding unit, said central grounding unit comprising a main section sandwiched between said first and said second fastening portions of said first and said second contacts, and a pair of latches extending from said main section towards said front mating face of said shielding shell.

10. The Universal Serial Bus connector as claimed in claim 9, wherein said shielding shell comprises an inner shell partially enclosing said first and said second contact modules, and an outer shell partially overlapped with and covering said inner shell, and wherein said pair of latches electrically and mechanically connect with said inner shell.

11. The Universal Serial Bus connector as claimed in claim 10, wherein said first contacts and said second contacts each provide a pair of grounding contacts, and comprise a plurality of signal contacts and power contacts sandwiched between said pair of grounding contacts.

12. The Universal Serial Bus connector as claimed in claim 11, wherein said signal contacts of said first contacts and said second contacts have four differential pairs.

13. The Universal Serial Bus connector as claimed in claim 7, wherein said pair of grounding contacts, said resilient pads and said connecting bar form a substantial U-shaped configuration.

14. The Universal Serial Bus connector as claimed in claim 6, further comprising a central grounding unit, said central grounding unit comprising a main section sandwiched between said first and said second fastening portions of said first and said second contacts, and a pair of latches extending from said main section towards said front mating face of said shielding shell.

* * * * *